United States Patent [19]

Golia, Jr. et al.

[11] Patent Number: 4,531,467

[45] Date of Patent: Jul. 30, 1985

[54] THREAD TAKE-UP ARM MECHANISM FOR AUTOMATIC COLOR CHANGE EMBROIDERY MACHINERY

[76] Inventors: Dominick Golia, Jr., 785 Townsend, New Haven, Conn. 06512; Kenneth R. Golia, 135 Canner St., New Haven, Conn. 06511

[21] Appl. No.: 595,474

[22] Filed: Mar. 30, 1984

[51] Int. Cl.[3] ..... D05B 25/00; D05B 69/02; D05B 49/00

[52] U.S. Cl. ..... 112/155; 112/163; 112/221; 112/247

[58] Field of Search ..... 112/163, 221, 98, 155, 112/247, 241

[56] References Cited

U.S. PATENT DOCUMENTS

| | | | |
|---|---|---|---|
| 1,234,398 | 7/1917 | Schwarzmann . | |
| 2,091,727 | 8/1937 | Bohmann et al. | 112/102 |
| 2,649,065 | 8/1953 | Casper | 112/84 |
| 2,856,873 | 10/1958 | Abel | 112/155 |
| 3,026,830 | 3/1962 | Bryant et al. | 112/79 |
| 3,118,403 | 1/1964 | Chambers | 112/79 |
| 3,348,506 | 10/1967 | Haberhauer et al. | 112/98 |
| 3,595,188 | 7/1971 | Schmedding et al. | 112/221 |
| 3,783,811 | 1/1974 | Schmedding et al. | 112/218 |
| 4,055,131 | 10/1977 | O'Brien et al. | 112/158 |
| 4,075,958 | 2/1978 | Sacchetti | 112/163 |
| 4,149,476 | 4/1979 | Wurst et al. | 112/158 |
| 4,276,838 | 7/1981 | Bolldorf | 112/221 |
| 4,285,289 | 8/1981 | Bolldorf et al. | 112/98 |
| 4,295,433 | 10/1981 | Desprez et al. | 112/241 |
| 4,366,763 | 1/1983 | Teetz et al. | 112/98 |
| 4,369,721 | 1/1983 | Bolldorf et al. | 112/98 |
| 4,369,722 | 1/1983 | Nishida et al. | 112/103 |

OTHER PUBLICATIONS

C. Schneider, *Embroidery: Schiffli & Multihead* (1978).
Tajima Drawing.

*Primary Examiner*—H. Hampton Hunter
*Attorney, Agent, or Firm*—Robert M. Isackson; Robert R. Jackson

[57] ABSTRACT

A thread take-up arm drive means for a multihead embroidery machine in which identical heads have automatic color change capability such that the color thread stitched on the plurality of embroidery heads is changed substantially simultaneously. A sliding carriage associated with each head contains a plurality of associated color stitching sets of thread take-up arms and needle bars. Each color stitching set is for stitching a different color thread. A computer controls a step motor to position the carriage and thus place the particular color stitching set in contact with the drive means. The thread take-up arm drive means is a pushplate biased in an up position by a leaf spring having adjustable tension. A cam follower is attached to the pushplate and moves the pushplate cyclically under force of and according to the design of the periphery of a cam. The cam is attached to the drive shaft that drives both the thread take-up arm and the needle bar of a color stitching set. The downward movement of the cam follower coincides with raising the thread take-up arm to pull the thread stitched taut and raising the needle out of the workpiece. The drive shaft does not operate during the color change operation.

10 Claims, 10 Drawing Figures

3
36a 36b 36c 36d 36e 36f
48
200a 200b 200c 200d 200e 200f
244
234
230f
202
144
140
240
166
44a
44c
44d
46
44b
156
170
152
148
66
232f
240
220f
40
54
52a
52b
40
238
242b
242d
242a
34c
242f
34a
34f
50a
34b
50b
50c
50d
50e
50f
236a
236b
236c
236d
236e
236f
26
12
3

THREAD TAKE-UP ARM MECHANISM FOR AUTOMATIC COLOR CHANGE EMBROIDERY MACHINERY

BACKGROUND OF THE INVENTION

This invention relates to apparatus for driving selectively one of a plurality of thread take-up arms of a multicolor embroidery machine head, wherein the head also contains one thread supply and one needle assembly for each thread take-up arm, and is constructed so that only one color stitching set, comprising a thread take-up arm, a needle assembly, and a thread supply can be driven at a time. The thread passes through a hole in the thread take-up arm and the needle in the needle assembly. During operation the needle assembly pierces a workpiece with a threaded needle, a stitch is formed, and the corresponding thread take-up arm pulls upwardly only that thread stitched to tighten the stitch while all other thread take-up arms, needle assemblies, and threads remain stationary.

The invention also relates to an apparatus for driving selectively one of a plurality of thread take-up arms of a multicolor embroidery machine head wherein a plurality of heads having the same construction are assembled to form a multihead embroidery machine, wherein each head is capable of shifting from a first selected color stitching set to a second selected color stitching set under computer control, thereby changing the color thread being stitched. Such multihead embroidery machines form stitches in the workpieces secured to a frame by moving the frame, under computer control, about the stitching points while the needle assemblies reciprocate vertically.

Single head embroidery sewing machines using only one thread take-up arm and only one needle driven from a common power source are old in the art. It is also known to construct a machine that has a plurality of embroidery machine heads with a single thread take-up arm and a single needle for stitching one color thread at a time, as is shown in Schmedding et al. U.S. Pat. No. 3,783,811, and Bohman et al. U.S. Pat. No. 2,091,727.

Individual embroidery machines having multiple needles on a single head are also known. Such needles may be arranged on a turret so that the color change is effected by manual rotation of the turret as shown in Schwarzmann U.S. Pat. No. 1,234,398 and Chambers U.S. Pat. No. 3,118,403. Both Schwarzmann and Chambers use tension devices to control thread advance, but neither show any thread take-up mechanism. Other multicolor embroidery machines have the several needles mounted in and arranged along either a curved or a flat plate, where change is effected by moving the plate, as shown in Sacchetti U.S. Pat. No. 4,075,958 and Bolldorf U.S. Pat. No. 4,276,838.

Multihead embroidery machines which also have some color change capability are also known in the art as shown in Desprez et al. U.S. Pat. No. 4,295,433, and as are available from Tajima Industries Ltd., Nagoya, Japan (for example Model TMB 112).

In one known multihead color change embroidery machine each head has only one thread take-up mechanism through which all threads pass. See for example Sacchetti U.S. Pat. No. 4,075,958. In a second known multihead embroidery machine, as shown in Desprez et al. U.S. Pat. No. 4,295,433, each head has one thread take-up mechanism which has several holes so that only one thread passes through each hole. The problem inherent in these machines is the constant motion of the take-up mechanism causes all of threads to move, including the threads not being stitched. This results in structural weakening of the threads, pulling the threads out of the needle, or tangling the threads in the apparatus, requiring shutdown of the embroidery machine for rethreading or repair.

Multihead machines with color change capability are known wherein there is a separate take-up lever associated with each color thread and needle. The thread take-up arms shown in the Tajima Industries Ltd. machines have a long connecting shaft or a series of axially aligned shafts directly connecting take-up arm mechanisms on adjacent heads together. The thread take-up levers shown in Bolldorf et al. U.S. Pat. No. 4,369,721 must rely on an elaborate geared apparatus involving a drive shaft, a thread take-up lever, a coupling member attached to the drive shaft, a coupling clutch to engage the drive shaft to the thread take-up lever and operate the thread take-up lever, such that the thread levers remain fixed relative to the stitching point, and a control shaft with a coupling and decoupling member for each thread lever for selecting which lever is operative, independent of needle movement.

One problem with conventional multihead and multicolor embroidery machines, as shown in the Tajima machine, is that the thread take-up mechanisms, mounted on sliding carriages, are connected together by either one long shaft that passes through every thread take-up mechanism and carriage and extends the length of the multihead machine, or by a series of shafts connecting adjacent thread take-up mechanisms and carriages. A second problem is that the movement of the thread take-up mechanisms on every head is dependent upon a single cam, located at one end of the machine. The cam picks up its motion directly from the main drive motor and causes the connecting shaft or shafts to rotate one-half or three-quarters turn about its longitudinal axis to move the thread take-up mechanism up and down.

These problems require that every head be aligned perfectly and oriented identically for the multihead machine to operate in both the stitching and the color change functions. Otherwise, rotation of the shaft to operate the thread take-up mechanism will bind rather than move the several misaligned thread take-up mechanisms. Similarly, the carriages on the several heads will not slide smoothly during the color change operation.

Further, a slight misalignment or breakdown of one head requires that the entire multihead machine be shutdown while the repair is made. Thus it is difficult to transport or move such a machine, and maintenance can be a costly necessity. An additional problem is that heads located furthest from the drive cam may not move in synchrony with the closer heads because of mechanical flexure inherent in the one or more connecting shafts, thus creating distorted and non-uniform patterns on the several workpieces.

The problem with the Bolldorf multihead and multicolor embroidery machines is that the coupling and decoupling means for driving the plurality of thread take-up arms are mechanically complicated. The multiplicity of gears are subject to wear and slippage over time, and the thread take-up arms are subject to backlash movements during decoupling. Consequently, the threads are subjected to variable tensions that weaken the thread and result in uneven stitches in the workpieces.

It is therefore an object of this invention to provide a multihead embroidery machine with automatic color change capability wherein each head has a plurality of color stitching sets of associated thread take-up arm, needle assembly, and color thread, and only one color stitching set is operative for stitching the associated color thread while the remaining sets are inactive and held motionless, and the color thread to be stitched is changed on each head by changing the color stitching set in stitching position.

It is another object of this invention to provide a thread take-up arm drive means, powered by a drive shaft, that reciprocates vertically under a biasing force exerted by a leaf spring that controls the motion of the thread take-up arm drive means.

It is another object of the invention to provide a multihead embroidery machine where each head has only one drive shaft for operating the thread take-up arm drive means and the needle assembly drive means, for driving only one of a plurality of color stitching sets at a time without any mechanical connection between thread take-up arms or needle assemblies of adjacent heads, and for providing an improved thread take-up arm motion and stitching action.

It is another object of the invention to provide a computer controlled color change apparatus for a multihead embroidery machine wherein a plurality of thread take-up arms are fixed in relation to a corresponding plurality of needle assemblies, both the thread take-up arms and the needles are mounted on a carriage, the movement of the carriage is controlled by a step motor that operates a horizontal gear rack affixed to the carriage to select and engage one thread take-up arm and one needle assembly to their respective drive means, the drive means being connected to the one drive shaft, and the computer controlling the drive means and the step motor associated with each head simultaneously so that the color change occurs on each head smoothly independently, and substantially simultaneously.

SUMMARY OF THE INVENTION

In a preferred embodiment the invention comprises a thread take-up arm apparatus for a multicolor and multihead embroidery machine. The invention is discussed with respect to one head unless otherwise indicated, although the discussion also applies to a plurality of identical heads combined to form a multihead machine.

Each head has one drive shaft for providing power to the stitching apparatus and the thread take-up arm apparatus of this invention. The drive shaft of a particular head can be disconnected from the drive motor to deactivate the head without interfering with the operation of the other heads in a multihead machine. The stitching apparatus, not forming a part of this invention, includes a needle drive means that reciprocates vertically along a guidepost, and is driven by a flywheel-extension arm apparatus connected to the end of the drive shaft. The needle drive means latches onto one of a plurality of needle assemblies. Each needle assembly comprises a needle bar mounted in the carriage for vertical movement, a latching protrusion attached to the midpoint of the needle bar, and a stitching needle attached to the lower end of the needle bar. The stitches are formed in conjunction with a conventional bobbin means.

The thread take-up arm apparatus comprises a drive means and the thread take-up arm array. The thread take-up arm array comprises a plurality of thread take-up arms spaced horizontally along a common shaft which is mounted in and fixed relative to a carriage slidably connected to the head. Each thread take-up arm comprises a base, teeth arranged along the edge of a curved section of the base, and a long curved projection extending from the base, opposite the teeth. At the end of the projection is a hole for the thread to pass through. The common shaft passes through the center of each base so that each arm rotates about the common shaft in a plane perpendicular to the front of the carriage and the longitudinal axis of the common shaft.

The drive means comprises a cam-pushplate-flange assembly attached near the carriage end of the drive shaft. The pushplate, having a rectangular hole through which the drive shaft passes, is placed between a cam and a flange so that it cannot move along the drive shaft. The pushplate hole permits the pushplate to move perpendicular to the axis of the drive shaft. The top of the pushplate comprises a linear gear whose top end passes through a hole in a bracket affixed on top of the head housing. The bracket allows the gear to reciprocate vertically and prevents the pushplate from rotating about the drive shaft.

A leaf spring biases the pushplate and consequently the linear gear in their maximum displacements from center along the path of movement. One end of the leaf spring is connected to the pushplate and the other end is connected to a tension adjustment device. The leaf spring is deflected over a fulcrum attached to the housing of the head, to provide the biasing force on the pushplate.

A cam follower is pivotably secured to the pushplate on the cam side of the pushpate. The biasing force exerted by the leaf spring causes the cam follower to contact and stay in contact with the periphery of the cam, limiting the extreme upward and downward position of the pushplate and linear gear, so that as the cam revolves, the pushplate and linear gear will reciprocate according to the design of the cam.

The linear gear has a series of grooves perpendicular to the longitudinal axis of the gear that corresponds to and will mesh with the plurality of teeth on the curved base of a thread take-up arm. When the linear gear is in contact with a thread take-up arm, the gear's vertical reciprocation rotates the thread take-up arm about the common shaft so that the curved projection traces an arc, alternately descending to allow the needle to advance the thread for stitching, and then ascending to pull the thread upwardly for pulling the stitch taut. The motion of the thread take up arm as it descends and ascends is controlled by the design of the cam's periphery.

The particular thread take-up arm of the chosen color stitching set is placed in contact with the linear gear by a step motor attached to the head housing. The step motor moves the carriage relative to the drive shaft, and thus relative to the thread take-up arm drive means and needle assembly drive means. The computer controls the step motor and drives the step motor to one of the preselected positions causing the carriage to slide and placing the selected color stitching set in contact with the respective drive means. Those thread take-up arms not to be driven are restrained from moving by a bracket, attached to the head, that engages a groove in the base of each take-up arm not placed in the stitching position.

The computer control means can be connected electrically to a plurality of step motors on each of a plurality of heads to construct a multihead machine wherein each head has the color change capability and thread take-up arm apparatus described above.

To effect the color change, the computer causes the drive shaft of each head to cease operating at the rotational position where the driven needle of each head is out of the workpiece. When the needle is out of the workpiece, the thread take-up arm is at its rest position, i.e., the groove in the base of the driven arm is aligned with the restraining bracket so that when the carriage translates, the groove will slide onto the restraining bracket. The step motors are activated substantially simultaneously to move all the carriages a given distance to replace the driven color stitching set with the next selected color stitching set. The teeth of the new thread take-up arm slide into engagement with the linear gear before the groove is disengaged from the restraining bracket so that the arm does not rotate during the color change function. When the corresponding take-up arms and needle assemblies on all the heads are in driving position, the computer then activates the drive shafts and embroidery continues with the new color thread on each head.

It is thus clear that there is a tremendous production advantage in being able to disconnect mechanically and electrically one head of plurality of heads for immediate or subsequent repair without the economic losses involved in having to shut down the entire multihead machine for repair. Further, because perfect alignment of the heads is not essential, the machine may be moved without requiring extensive or expensive realignment, and the workpiece position in the workpiece holder can be adjusted to provide perfect work. Because each head has it own power source, all the thread take-up arms move in synchrony within their respective needle assemblies and there is no non-uniformity in the work from one head to the next. Additionally, the smooth action of the needle and thread take-up arm drive means provided by the cam design prevents unnecessary wear and tear on both the machine and the threads.

BRIEF DESCRIPTION OF THE DRAWINGS

FIG. 8 is an isolated perspective rear view of FIG. 7.

DETAILED DESCRIPTION OF THE INVENTION

Figure 1:
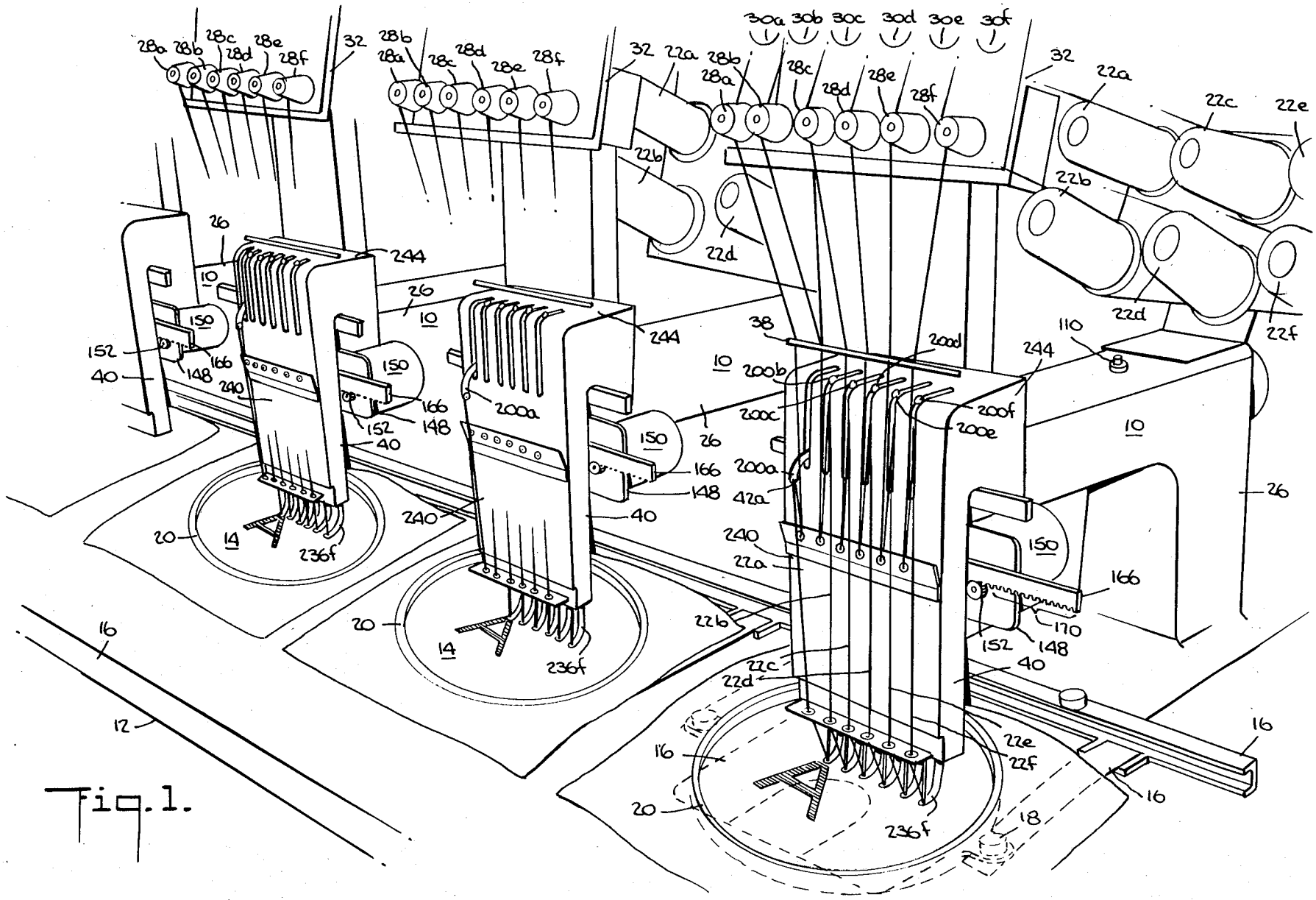
FIG. 1 is a partial perspective view of an illustrative embodiment of the multihead automatic color change embroidery machine of this invention.
Figure 3:
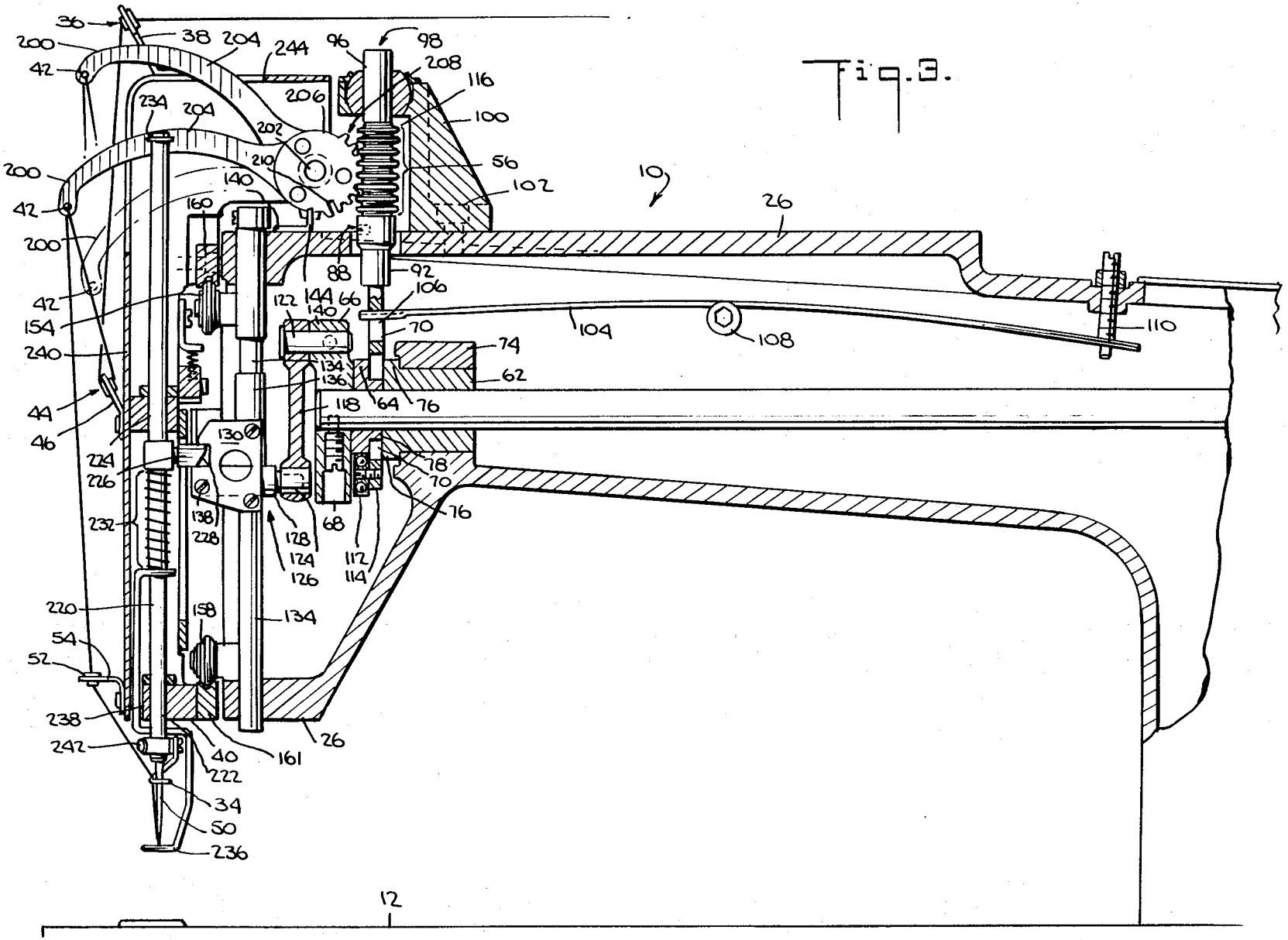
FIG. 3 is a partial cross sectional view, taken along line 3—3 of FIG. 2.

As shown in FIGS. 1 and 3, an illustrative embodiment of a multihead automatic color change embroidery machine comprises a plurality of embroidery machine heads 10 arranged along table 12 in substantially the same orientation, frame 16 for receiving a plurality of workpieces 14, fasteners 18 and rim 20 for securing each workpiece 14 to frame 16 in a selected orientation under each machine head 10 for stitching, means for moving frame 16 stepwise in the X and Y directions to form a stitch (not shown), and computer means (not shown) for controlling the movement of frame 16, drive shaft 60, and the color change apparatus as described more fully below. Frame 16 is moved stepwise while stitching occurs to create the embroidery pattern represented by the letter A in FIG. 1. A plurality of different color threads 22(*a–f*) are mounted on spindle rack 24 which is mounted on the embroidery head housing 26. (The identifying letters a–f refer to one of six parallel structures, such that all structural components having the same identifying letter, e.g., a, are functionally related to each other but separate from all structural components having identifying letter b, or c, or d, or e, or f. For example, 22*a* is identical in form and function to 22*b*, but 22*a* is associated with one structure and 22*b* is associated with a second structure, such that the first and second structures are associated with stitching different color threads. See FIG. 1. When the identifying letter is not used, the reference is to the particular structural component's form and function and not to any particular structure that would be associated with a particular color.) Each color thread 22 (*a–f*) passes through holes 30(*a–f*) in plate 32, through thread tension adjustment means 28(*a–f*), through holes 36(*a–f*) in bracket 38 mounted on top plate 244 of carriage 40, down through holes 44(*a–f*) in bracket 46 mounted on front cover plate 240 of carriage 40, up through holes 42(*a–f*), down through holes 52 in bracket 54 mounted on front cover plate 240, and finally over bars 34(*a–f*) and through holes (not shown) in stitching needles 50(*a–f*). Not shown below table 12 is the bobbin means for catching thread 22 being stitched and forming the stitch, as this apparatus and procedure are well known in the art. The means for moving frame 16 is not shown because it too is known in the art, for example X, Y step motors, or a bell crank mechanism, as is commercially available in embroidery machines sold by Ultramatic Embroidery Machinery Co., New Haven, Conn. e.g. Ultramatic model 400.

Figure 2:
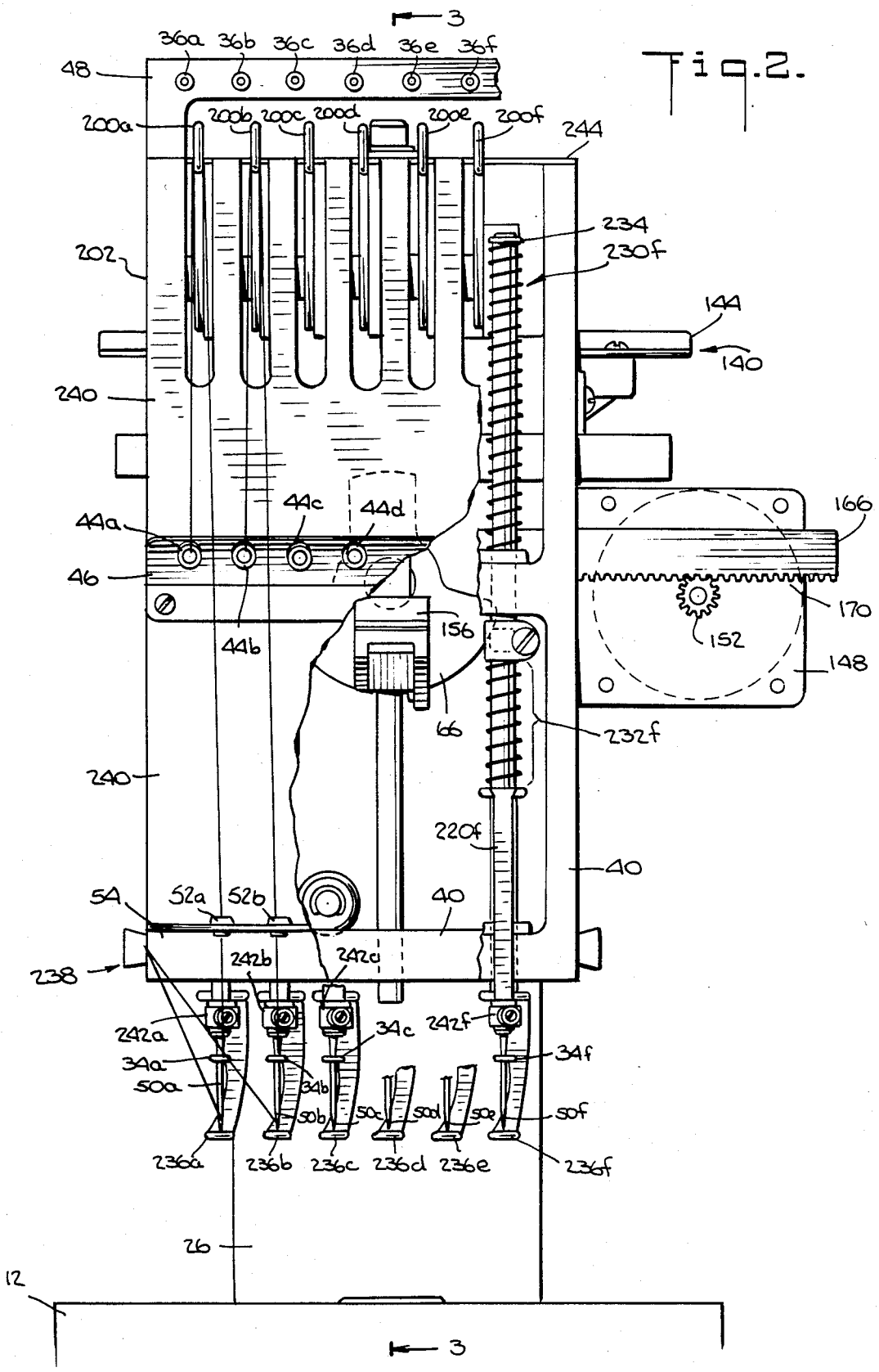
FIG. 2 is a front sectional view of a single embroidery machine head of FIG. 1.
Figure 7:
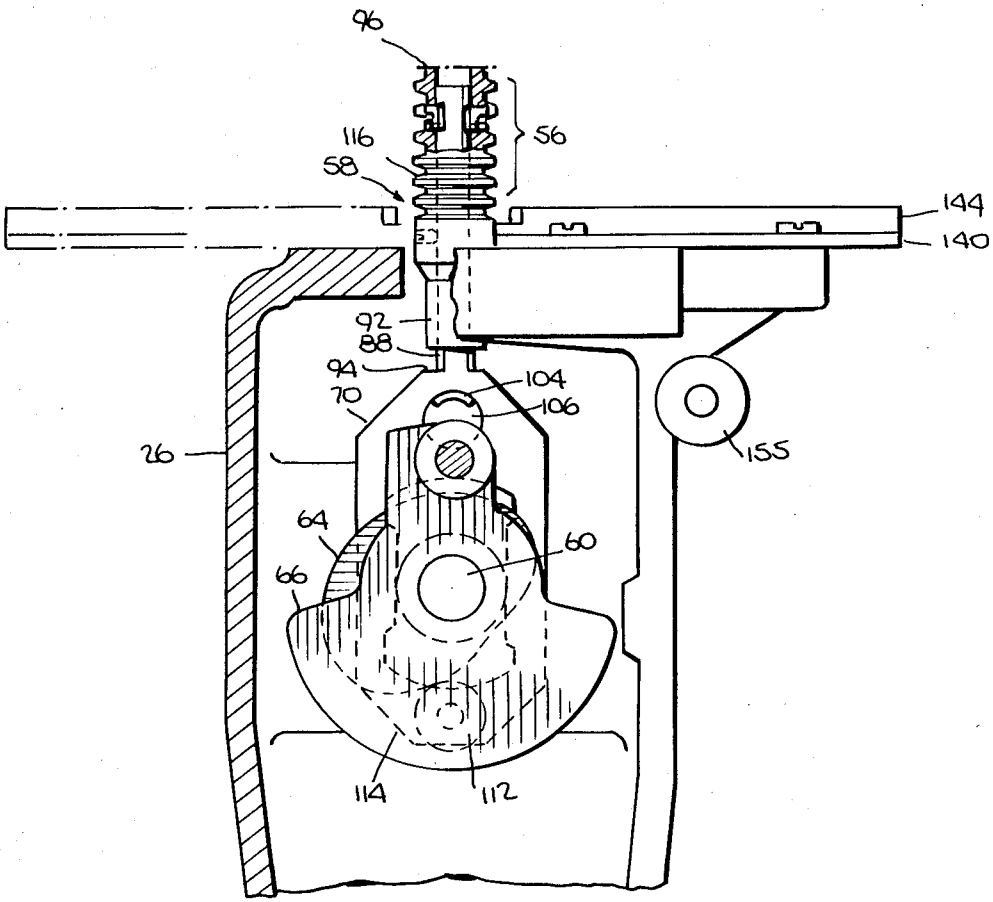
FIG. 7 is a front partial sectional view of FIG. 2.
Figure 9:
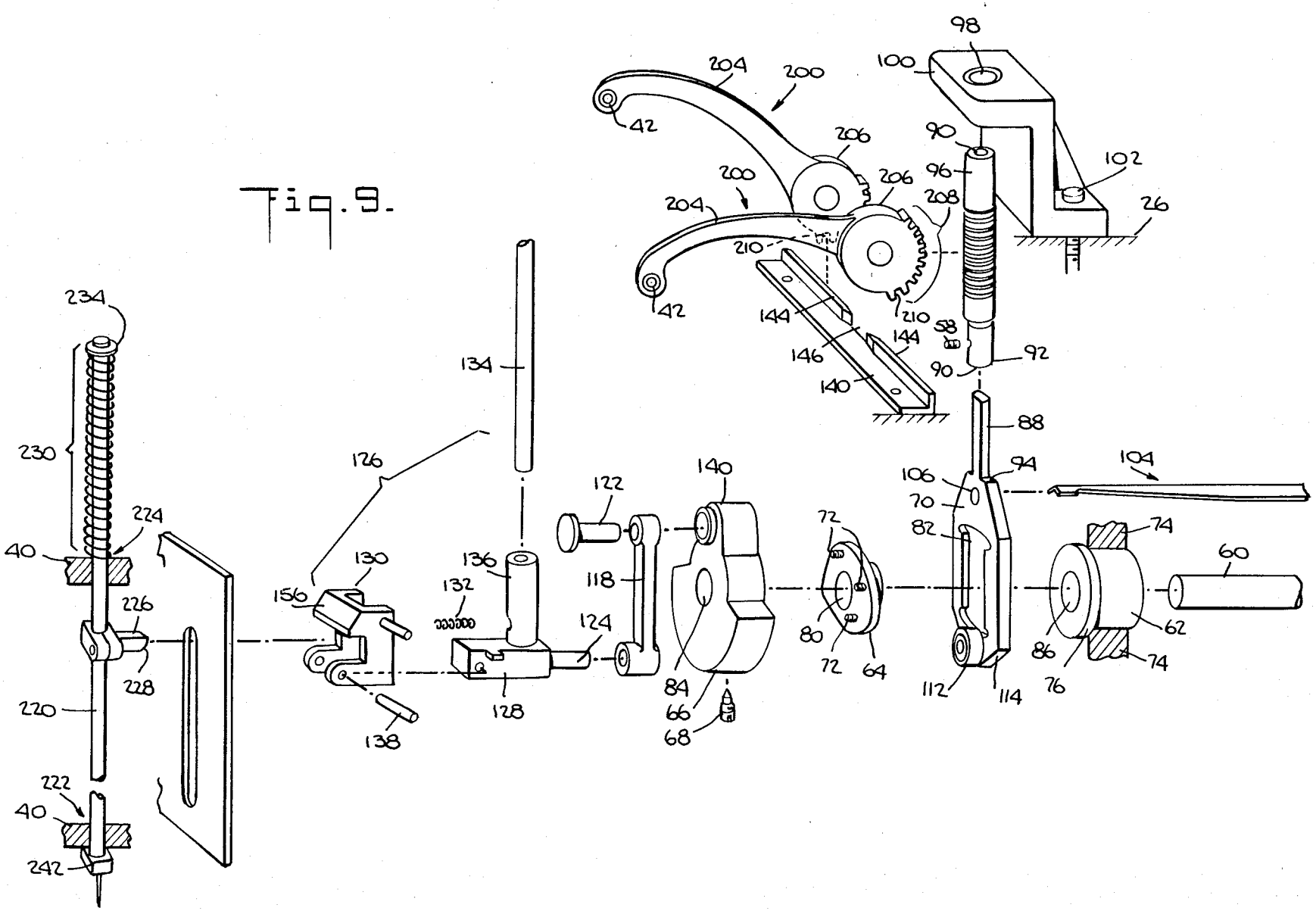
FIG. 9 is an exploded perspective view of FIG. 3.

FIGS. 2, 3, and 9 show the internal structure of each head 10. Again the description is given only in terms of one head even though applicable to each head of a multihead embroidery machine. Drive shaft 60 is driven by a power supply means not shown. This power supply means, a single motor having a computer controlled clutch, drives a series of linked timing belts, timing pulleys and idlers that starts, stops, and incrementally advances each drive shaft 60 in each machine head 10. The motor is a 110 volt single phase motor, and is commercially available from Mitsubishi Ltd. Tokyo, Japan, model number CAZ402E, and such a linked timing belt and timing pulley drive means is available from Ultramatic Embroidery Machinery Co., New Haven, Conn., Ultramatic model 1200. Referring also to FIGS. 7 and 8, drive shaft 60 passes through hole 86 in main bearing 62, hole 80 in cam 64, pushplate 70, and hole 84 in flywheel 66. Flywheel 66 is secured to the carriage end of drive shaft 60 by set screw 68. Cam 64 is secured to flywheel 66 by three set screws 72. Cam 64 and flywheel 66 remain stationary relative to drive shaft 60. Bearing 62 is inserted into boss 74 of housing 26 where it is retained by bearing flange 76 and is held in position by abutting cam flange 78 and pushplate 70. Pushplate 70 has rectangular hole 82 designed for allowing pushplate 70 to reciprocate vertically about cam flange 78, without any horizontal motion. Pushplate 70 has a thickness substantially equal to the thickness of cam flange 78, as measured longitudinally to the axis of drive shaft 60, and is restrained from moving along driveshaft 60 by abutment against and between cam 64 and bearing flange 76. Thus bearing 62, pushplate 70, cam 64, and flywheel 66 do not move along the length of drive shaft 60.

Linear gear 116 has aperture 90 for receiving protrusion 88 of pushplate 70. Lower end 92 of linear gear 116 abuts flange 94 of pushplate 70 and is held in place by set screw 58. Upper end 96 of linear gear 116 is slidably engaged in hole 98 of bracket 100 which is secured to housing 26 by fasteners 102. Linear gear 116 has a plurality of teeth 56, extending about the circumference of gear 116 which has an annular cross section.

One end of leaf spring 104 is inserted into pushplate hole 106, located between pushplate hole 82 and pushplate flange 94. The spring is deflected over fulcrum 108 and is secured at the other end to an adjustable set screw 110 for adjusting the force exerted upwardly by leaf spring 104 on pushplate 70.

Cam follower 112 is secured to pushplate lower end 114. Because of the upward forces exerted by leaf spring 104, pushplate 70 and cam follower 112 are maintained in their uppermost position. Thus, cam follower 112 is maintained in contact with the periphery of cam 64 directly beneath the drive shaft, limiting the upward motion of pushplate 70 in accordance with the design of cam 64. From FIG. 8 it is seen that the periphery of cam 64 comprises a series of linked arc-lengths. The length and radius of curvature of any particular section can be adjusted to give the desired stroke pattern for any given stitching condition. For example, one arc length section may have up to an infinite radius of curvature so that the thread take-up arm remains relatively motionless, allowing the tension on the thread to stabilize to provide more even stitches in a workpiece. Additionally, the length of one arc may be increased to provide a longer stroke.

Linear gear 116 is the thread take-up arm drive means for operating the thread take-up arm 200 placed in stitching position.

Extension arm 118 is rotatably secured between one end to unweighted end 120 of flywheel 66 by means of retaining pin 122. The other end of extension arm 118 has a hole for receiving protrusion 124 of needle drive means 126. Needle drive means 126 comprises drive base 128, protrusion 124, needle latch 130, and spring 132 for biasing latch 130 in an upright latched condition. Latch 130 is pivotably attached to drive base 128 by pin 138. Attached to drive base 128 is tube 136, and extending through drive base 128 and tube 136 is guide post 134 for keeping the movement of needle drive means 126 vertical. Guidepost 134 is secured at its upper and lower ends to housing 26.

Figures 4, 5:
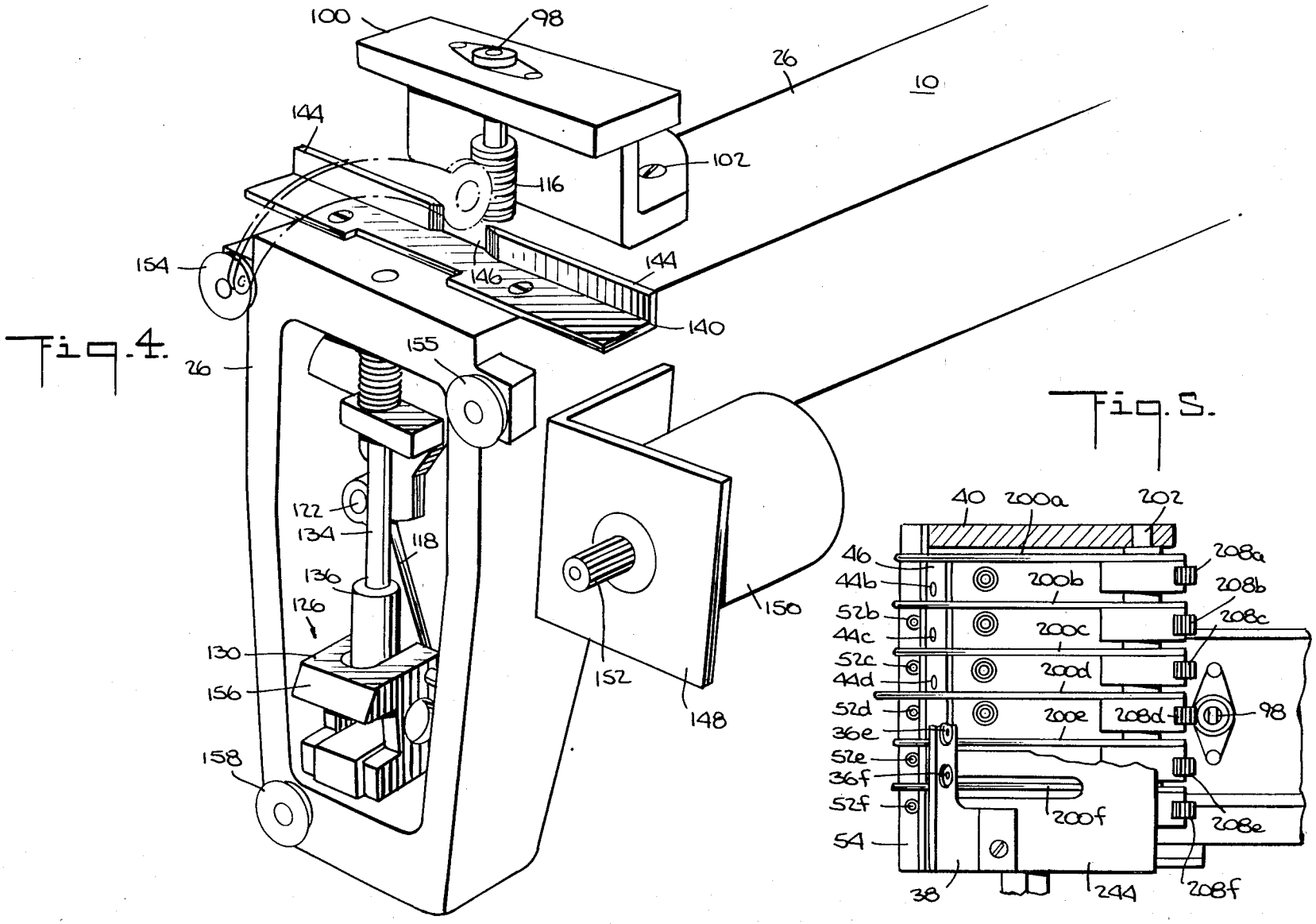
FIG. 4 is an internal perspective view of the head of FIG. 2.
FIG. 5 is a top sectional view of FIG. 2.

FIGS. 4, 5, and 7 show the take-up arm restraining means as right angle bracket 140, secured to the top of housing 26 with rail 144 perpendicular to the housing. Rail 144 has gap 146 corresponding to the position adjacent linear gear 116. Gap 146 allows the thread take-up arm in stitching position to rotate without touching rail 144, and is narrow enough so that thread take up arm 200 can pass from one side of gap 146 to the other side without rotating—teeth 56 of linear gear 116 engage teeth 208 of thread take-up arm 200 before groove 210 disengages from rail 144 to prevent arm 200 from rotating during the color change operation.

Also shown in FIG. 4 is step motor 150 mounted in bracket 148 which is secured to the side of housing 26. Step motor 150 has as its spindle output shaft toothed circular gear 152. The step motor is a 6 volt servo stepping motor having a 1.8° step, and is available from Japan Servo Company, Ltd., Tokyo, Japan, model type KP6M2-008.

Mounted at the front of housing 26 are guide wheels 154, 155, and 158 (only three shown in FIG. 4, a fourth wheel is not shown), oriented to turn in a plane perpendicular to drive shaft 60 so that wheel 154 and wheel 155 are aligned horizontally and wheel 158 and the fourth wheel are aligned horizontally.

Figure 6:
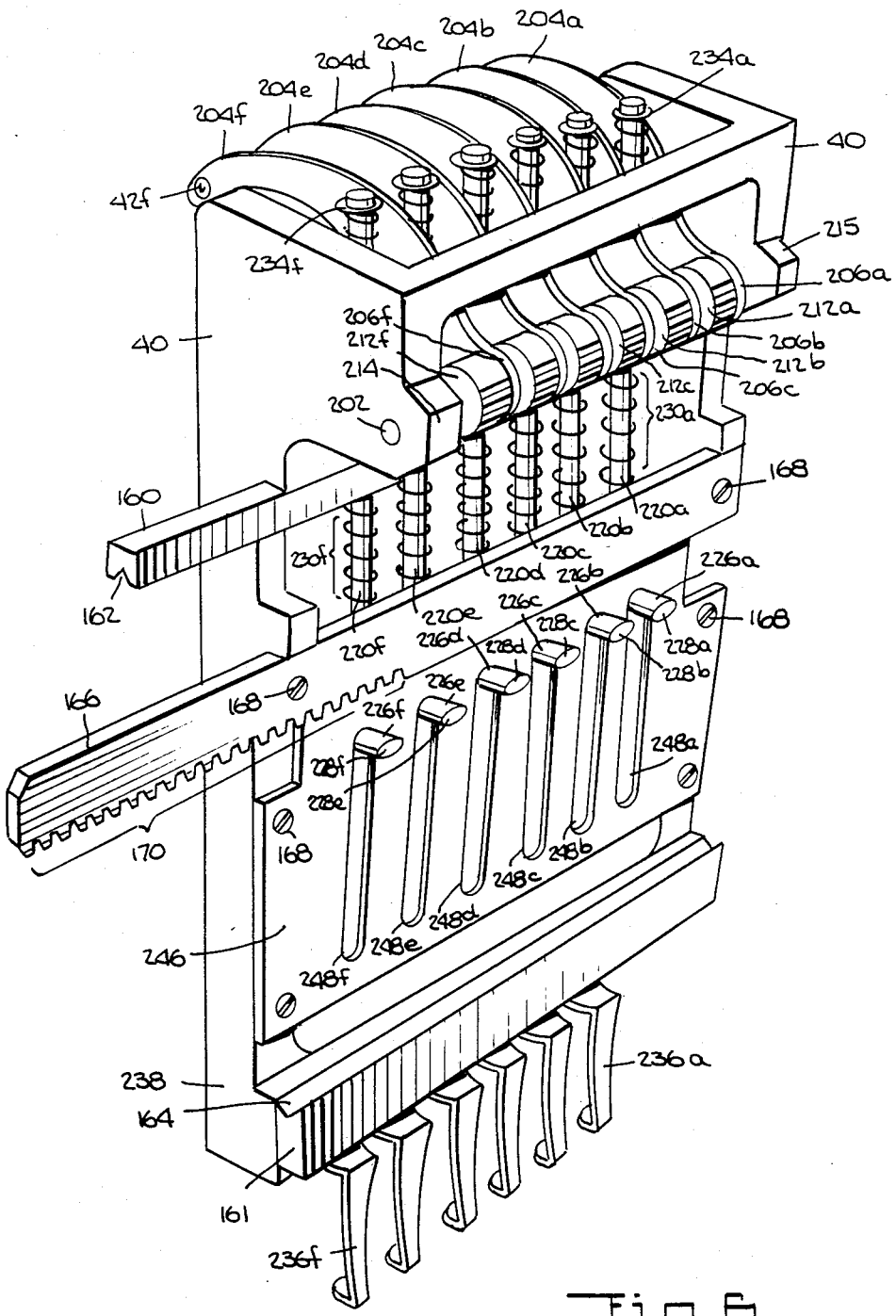
FIG. 6 is a perspective view of the rear of the carriage of FIG. 2.
Figure 6:
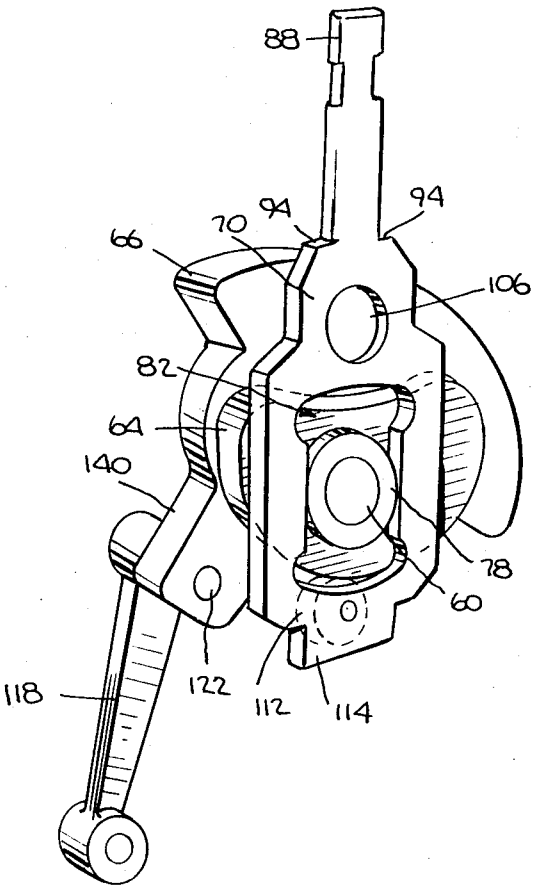

FIGS. 2, 3, 5, and 6 show a plurality of thread take-up arms 200(*a–f*) having parallel structure arranged along and rotatable about shaft 202. Each thread take-up arm 200 comprises a long curved projection 204 having hole 42 at its end, and base 206 having plurality of teeth 208 about a circular portion of the base and groove 210 for engaging rail 144 for preventing take-up arm 200 from rotating about shaft 202. Shaft 202 is secured between bosses 214 and 215, located on the rear of carriage 40 (FIG. 6). Bushings 212(*a–f*) separate the thread take-up arms 200(*a–f*) and prevent any significant side to side motion of thread take-up arms 200(*a–f*).

A plurality of needle bars 220(*a–f*) having parallel structure are spaced apart and along the interior of carriage 40. Each needle bar 220 is mounted for vertical reciprocation, passing through lower holes 222 and upper holes 224 on carriage 40 as shown in FIG. 3. Protrusion 226, having beveled end 228, is securely mounted on each needle bar 220 at about the midpoint of the needle bar. Upper spring 230 surrounds needle bar 220 and is maintained in tension between upper hole 224 and retaining clip 234 located at the top of needle drive bar 220. Lower spring 232 is maintained in tension between S-shaped bracket 236 and protrusion 226. The upper side wall of S-shape bracket 236 is slidably retained between area 238 of carriage 40 and front plate 240 for vertical reciprocation. The middle horizontal leg of S-shape bracket 236 is forced downward by spring 232, and forced upward by needle mounting means 242, so that as the needle bar moves downwardly, S-shaped bracket 236 moves downwardly for acting as a presser foot when stitching. Spring 230 exerts a greater force than spring 232 thereby maintaining needle bar 220 in its uppermost position, defined by the point where protrusion 226 abuts the lower extreme of upper hole 224. Needle mounting means 242 secures needle 50 to the lower end of needle bar 220. Needle 50 and S-shape bracket 236 reciprocate only when corresponding needle bar protrusion 226 is in contact with needle drive means 126. The stroke length is identical to the stroke of needle drive means 126 (See FIG. 10).

Top plate 244 is secured to the top of carriage 40, having slots for allowing thread take-up arms 200(*a–f*) to rotate and holes for allowing needle bars 220(*a–f*) to reciprocate. Front cover plate 240 is secured to the front of carriage 40. Both top plate 244 and front cover plate 240 prevent dust and extraneous objects from interfering with the interior components of carriage 40.

FIG. 6 shows how rear cover plate 246 is secured to carriage 40, having slots 248(*a–f*) for allowing needle bar protrusions 226(*a–f*) to protrude far enough out the rear of carriage 40 to be latched by needle latch 130 of needle drive means 126 when the needle bar to be driven is placed directly in front of needle drive means 126. Top guide rail 160 has downwardly facing groove 162 for receiving the periphery of wheels 154 and 155 (see FIG. 3) and is parallel to bottom guide rail 161 which has an upwardly facing groove 164 for receiving wheel 158 and the fourth wheel thereby providing a mounting means for slideably attaching carriage 40 to housing 26.

Carriage 40 is restrained from freely sliding on the wheels by horizontal gear rack 166 which is secured to carriage 40 by screws 168. Teeth 170 of gear rack 166 mesh with toothed gear 152 of step motor 150 when carriage 40 is attached properly to housing 26. Thus step motor 150 positions a selected thread take-up arm 200 relative to linear gear 116 and a selected needle bar protrusion 226 relative to needle drive means 126 by rotation of its spindle output shaft and toothed gear 152. Step motor 150 has, in this embodiment, six positions, each position corresponding to one of the plurality of thread take up arms 200(*a–f*) and one of the plurality of needle bars 220(*a–f*). For example, in position 1, thread take-up arm 200*a* is located so that teeth 208*a* of base 206*a* mesh with linear gear 116. As drive shaft 60 rotates, cam 64 acts on cam follower 112 causing push-plate 70 and linear gear 116 to reciprocate and base 206*a* and curved projection 204*a* to rotate about shaft 202. Thread take-up arms 200(*b–f*) remain stationary because grooves 210(*b–f*) are engaged on side 144 of take-up arm restraining means 140. Simultaneously, needle bar 220*a*, located adjacent needle bar drive means 126 so that needle bar protrusion 226*a* is retained inside needle latch 130, reciprocates. Beveled face 156 of latch 130 and beveled end 228*a* of protrusion 226*a* are designed so that as latch 130 moves upwardly it can pivot about pin 138 as beveled face 156 passes beveled end 228*a*. Spring 132 restores latch 130 to normal, latching protrusion 226*a* after beveled face 156 passes beveled end 228*a*. Thus, when needle bar drive means 126 moves downwardly, the needle bar 220*a* is driven downwardly to push thread 22*a* through workpiece 14 and begin forming a stitch. As needle 50*a* moves downwardly, thread take-up arm 200*a* moves downwardly. After the stitch is formed, needle 50*a* moves upwardly and thread take-up arm 200*a* moves upwardly, pulling the stitch taut. See FIG. 10. Needle bars 220(*b–f*) remain stationary, as held in their uppermost stroke position by upper springs 230(*b–f*).

When step motor 150 changes from position 1 to position 2, a computer program containing all information required to stitch the desired embroidery pattern instructs the computer control means on every head to stop drive shaft 60 from revolving by stopping the main drive motor mentioned above. Drive shaft 60 is stopped with needle 50 out of workpiece 14 and base 206*a* of thread take-up arm 200*a* oriented so that groove 210*a* is facing downwardly in alignment with rail 144 of take-up arm restraining means 140. See the discussion below relating to position D in FIG. 10. Step motor 150 is activated causing toothed gear 152 to rotate, sliding carriage 40 from position 1 to 2, simultaneously shifting thread take-up arm 200*a* and needle bar 220*a* out of alignment with their respective drive means. As groove 210*a* moves out of engagement with linear gear 116 it moves into engagement with rail 144 where it is restrained from rotating. Simultaneously, spring 230*a* restores needle bar 220*a* to rest at its uppermost stroke position. Thread take-up arm 200*b* is moved adjacent linear gear 116 and needle bar 220*b* is moved adjacent needle drive means 126 so that teeth 208*b* on base 206*b* engage linear gear 116 before disengaging from rail 144. When movement is stopped, groove 210*b* is centered in gap 146 of take-up arm restraining means 140. Simultaneously, needle bar protrusion 226*b* is placed adjacent needle latch 130 so that if it is not yet latched it becomes latched on the first upstroke of needle latch 130, as described above.

It will be apparent that the computer control means can change step motor 150 from any position to any other position by appropriate rotation of toothed gear 152.

Figure 10:
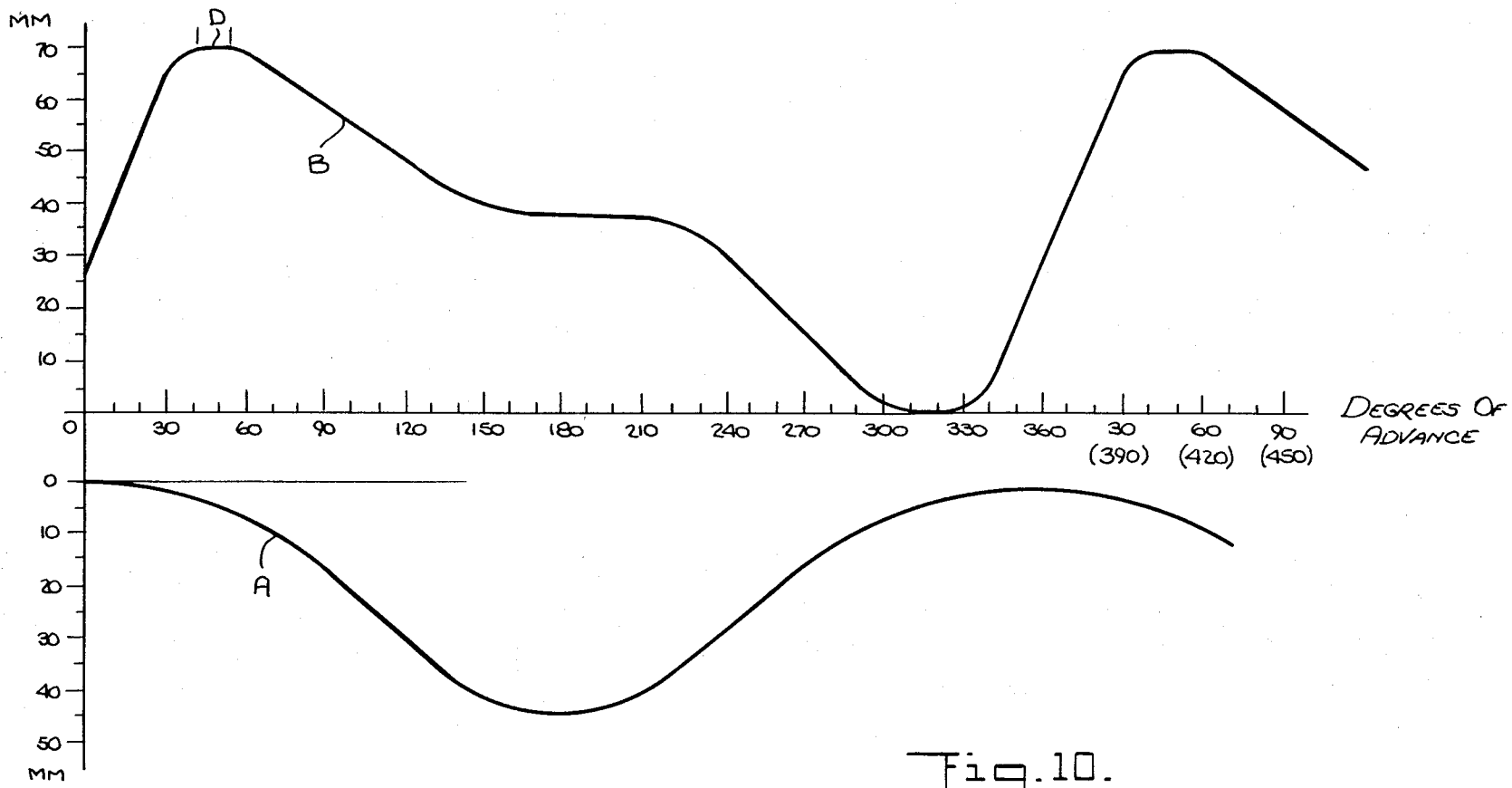
FIG. 10 is a diagramatic representation of the cyclic movement of an illustrative embodiment of the multihead automatic color change embroidery machine of this invention.

FIG. 10 shows diagramatically the relative displacement versus degree of drive shaft advance (herein "advance") for the end of thread take-up arm 200 (line B) and needle 50 (line A). Zero degree advance represents the maximum height of needle 50. Thread take-up arm 200 has an upper rest position D at about 40° to 50° advance, and a lower rest position at 310° to 320° advance. Color change occurs at between 40° and 50° advance. Thread take-up arm 200 moves gradually downwardly from about 60° to about 315° advance such that movement is slowed temporarily from about 130° to 210° advance while the tension of thread 22 adjusts itself.

The motion of needle 50 is sinusoidal, having a maximum penetration of workpiece 14 at 180° advance, as powered by flywheel 66 and extension arm 118 in response to the revolution of drive shaft 60.

The ascending motion of thread take-up arm 200 from 315° to 400° advance is faster than the ascending speed of needle 50 over the same advance so that the thread stitched is pulled taut. Thread take-up arm 200 is then at its upper rest position at 400° to 410° advance for a time period, allowing the stitch to stabilize as the next stitching cycle commences. The stroke of needle 50 ranges about 45 mm over a cycle, and thread take-up arm 200 travels about 70 mm.

It is apparent that a plurality of embroidery machine heads having the construction described above can be advantageously assembled together to form a single multihead embroidery machine. Such a machine would not have any mechanical linkage between adjacent heads other than the described belt connection to the common drive motor. The heads would operate in synchrony under the control of the computer. Both the sliding carriage containing the plurality of color stitching sets and the step motor associated with each head are mechanically and electrically independent from all other carriages and step motors. Thus, the color change operation of the multihead embroidery machine occurs more quickly, simply, and reliably than those available previously in known multicolor embroidery machines.

As various changes can be made in the above constructions without departing from the scope of the invention, it is intended that all matter contained in the above description or shown in the accompanying drawings shall be interpreted as illustrative and not in a limiting sense.

We claim:

1. Improved apparatus for rotating one of a plurality of thread take-up arms in a multicolor embroidery machine head in which each thread take-up arm is threaded with a different thread, has a toothed gear section, and is mounted on a carriage for rotation between an arm up position and an arm down position, the embroidery machine head having means for stitching and a drive shaft for providing power to the means for stitching, wherein the improvement comprises:

a linear gear having a frictional surface extending along its periphery;

stroke means connected to the drive shaft for converting the motion of the drive shaft into linear translation of the linear gear between a first stroke position and a second stroke position; and shift means for moving the carriage and selectively placing the toothed gear section of one of the plurality of thread take-up arms in frictional contact with the frictional surface of the linear gear so that as the linear gear moves between the first stroke position and the second stroke position the thread take-up arm rotates between the arm up position and the arm down position.

2. The apparatus of claim 1 wherein the stroke means comprises:

a cam, associated with and driven by the drive shaft, having a plane of revolution and a peripheral design in the plane of revolution;

a pushplate secured to the linear gear;

a cam follower rotateably attached to the pushplate;

first guide means for allowing the pushplate, cam follower, and linear gear to move in a direction perpendicular to the longitudinal axis of the drive shaft so that the cam follower remains in the plane of rotation of the cam; and spring means for maintaining the cam follower in contact with the periphery of the cam as the cam revolves to translate the linear gear between a first stroke position and a second stroke position.

3. The apparatus of claim 2 wherein the spring means comprises a leaf spring, connected at one end to the pushplate and at the other end to the head, exerting a force on the pushplate so that the cam follower remains in contact with the periphery of the cam as the cam revolves to translate the linear gear between a first stroke position and a second stroke position.

4. The apparatus of claim 1 wherein the shift means comprises:

mounting means for slideably connecting the carriage containing the plurality of thread take-up arms to the head; and a step motor, mounted on the head having a rotatable output shaft engageably connected to the carriage for sliding the carriage as the output shaft rotates so that the step motor can selectively stop the carriage at a plurality of locations, each location corresponding to placing the toothed gear section of a selected thread take-up arm in contact with the frictional surface of the linear gear, so that as the linear gear moves between the first stroke position and the second stroke position the selected thread take-up arm rotates between the arm up position and the arm down position.

5. The apparatus of claim 4 wherein the mounting means further comprises a horizontal gear rack for engageably connecting the output shaft of the step motor so that the sliding motion is linear.

6. The apparatus of claim 2 wherein the shift means comprises:

mounting means for slideably connecting the carriage containing the plurality of thread take-up arms to the head; and a step motor, mounted on the head having a rotatable output shaft engageably connected to the carriage for sliding the carriage as the output shaft rotates so that the step motor can selectively stop the carriage at a plurality of locations, each location corresponding to placing the toothed gear section of a selected thread take-up arm in contact with the frictional surface of the linear gear, so that as the linear gear moves between the first stroke position and the second stroke position the selected thread take-up arm rotates between the arm up position and the arm down position.

7. The apparatus of claim 6 wherein the mounting means further comprises a horizontal gear rack for engageably connecting the output shaft of the step motor so that the sliding motion is linear.

8. Improved apparatus for rotating one of a plurality of thread take-up arms in a multicolor embroidery machine head in which each thread take-up arm is threaded with a different thread, the embroidery machine head having a drive shaft for providing power, a pushplate having an aperture for allowing the pushplate to reciprocate between a first position and a second position about the drive shaft in a direction perpendicular to the longitudinal axis of the drive shaft, guide means for preventing the pushplate from rotating about the drive shaft, gear means responsive to movement of the pushplate for rotating the selected thread take-up arm, and shift means for selectively moving one of the plurality of thread take-up arms and placing it in contact with the gear means, wherein the improvement comprises:

stroke means connected to the drive shaft for translating the motion of the drive shaft into linear motion having a first extreme position and a second extreme position; and a leaf spring connected at one end to the pushplate and at the other end to the head for biasing the pushplate against the stroke means so that as the drive shaft revolves, the pushplate reciprocates between the first position and the second position.

9. The apparatus of claim 8 wherein the stroke means comprises:

a cam follower pivotably attached to the pushplate;

a cam associated with and driven by the drive shaft having a plane of revolution; and second guide means for maintaining the cam follower in the plane in which the cam revolves so that the leaf spring maintains the cam follower in contact with the cam periphery as the cam revolves for translating the motion of the cam into linear motion of pushplate.

10. The apparatus of claim 8 wherein the shift means comprises:

a carriage, slideably engaged to the head for containing the plurality of thread take-up arms, having a horizontal gear rack; and a step motor, mounted on the head having a rotatable output shaft engageably connected to the horizontal gear rack for sliding the carriage transversly as the output shaft rotates so that the step motor can stop the carriage at any of a plurality of locations, each location corresponding to placing one of the plurality of thread take-up arms in contact with the gear means.

* * * * *